US009636926B2

(12) United States Patent
Aoyagi

(10) Patent No.: US 9,636,926 B2
(45) Date of Patent: May 2, 2017

(54) PRINT MEDIUM, PRINT MEDIUM UNIT AND PRINTING DEVICE

(71) Applicant: Seiko Epson Corporation, Tokyo (JP)

(72) Inventor: Naohiko Aoyagi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/909,107

(22) PCT Filed: Jul. 28, 2015

(86) PCT No.: PCT/JP2015/003767
§ 371 (c)(1),
(2) Date: Jan. 30, 2016

(87) PCT Pub. No.: WO2016/017145
PCT Pub. Date: Feb. 4, 2016

(65) Prior Publication Data

US 2016/0257130 A1 Sep. 8, 2016

(30) Foreign Application Priority Data

Aug. 1, 2014 (JP) ..... 2014-157462

(51) Int. Cl.

| | |
|---|---|
| ***B41J 2/325*** | (2006.01) |
| ***B41M 5/50*** | (2006.01) |
| ***B41J 35/16*** | (2006.01) |
| ***B41M 5/382*** | (2006.01) |
| ***B41J 17/32*** | (2006.01) |
| ***B41M 5/28*** | (2006.01) |
| ***B41M 5/30*** | (2006.01) |
| ***B41M 5/34*** | (2006.01) |
| ***B41J 3/407*** | (2006.01) |
| ***B41J 2/32*** | (2006.01) |

(52) U.S. Cl.

CPC ..... *B41J 2/325* (2013.01); *B41J 17/32* (2013.01); *B41J 35/16* (2013.01); *B41M 5/28* (2013.01); *B41M 5/30* (2013.01); *B41M 5/34* (2013.01); *B41M 5/382* (2013.01); *B41M 5/502* (2013.01); *B41J 2/32* (2013.01); *B41J 3/4075* (2013.01); *B41M 5/345* (2013.01); *B41M 2205/04* (2013.01); *B41M 2205/30* (2013.01)

(58) Field of Classification Search

CPC ..... B41J 2/325; B41J 35/16; B41J 3/36; B41J 17/32; B41J 2/32; B41M 5/502; B41M 5/30; B41M 5/34; B41M 5/50; B41M 5/28; B41M 2/32; B41M 5/382; B41M 5/337

See application file for complete search history.

(56) References Cited

FOREIGN PATENT DOCUMENTS

| | | |
|---|---|---|
| JP | 56-126192 A | 10/1981 |
| JP | 56-157395 A | 12/1981 |

(Continued)

*Primary Examiner* — Julian Huffman
(74) *Attorney, Agent, or Firm* — ALG Intellectual Property, LLC

(57) ABSTRACT

Printing using two colors can be performed by a thermal print head. A base member, a thermosensitive color developing material layer formed by applying a thermosensitive color developing material on the entire surface of the base member, and a thermosensitive decolorizing material layer formed by applying a thermosensitive decolorizing material having a decolorizing temperature different from a color developing temperature of the thermosensitive color developing material on the entire surface of the thermosensitive color developing material layer, are provided.

7 Claims, 7 Drawing Sheets

(56) References Cited

FOREIGN PATENT DOCUMENTS

| | | | |
|---|---|---|---|
| JP | 61-242880 | A | 10/1986 |
| JP | 5-32045 | A | 2/1993 |
| JP | 10-250123 | A | 9/1998 |
| JP | 11-105425 | A | 4/1999 |
| JP | 2000-52653 | A | 2/2000 |
| JP | 2000-326644 | A | 11/2000 |
| JP | 2003-276224 | A | 9/2003 |
| JP | 3727747 | B | 12/2005 |
| JP | 2009-528936 | A | 8/2009 |
| JP | 2009-226614 | A | 10/2009 |
| JP | 2012-245769 | A | 12/2012 |
| JP | 2013-75500 | A | 4/2013 |

[ FIRST MODIFICATION ]

[ SECOND MODIFICATION ]

[ THIRD MODIFICATION ]

PRINT MEDIUM, PRINT MEDIUM UNIT AND PRINTING DEVICE

CROSS-REFERENCE TO RELATED APPLICATION

The entire disclosure of Japanese Patent Application No. 2014-157462, filed on Aug. 1, 2014, is expressly incorporated by reference herein.

TECHNICAL FIELD

The present invention relates to a print medium and a print medium unit used for a printing device with a thermal print head, and a printing device.

BACKGROUND ART

Traditionally, as a printing device, a device which has a cartridge holder accommodating a tape cartridge, and a printing mechanism with a thermal head, is known (see JP-A-2013-75500). In the tape cartridge used in such a printing device, a thermosensitive tape is accommodated in a winding state as a print target medium and this thermosensitive tape is made up of a film with a thermosensitive layer, an adhesive layer, and a release paper stacked on each other. Meanwhile, the printing mechanism drives the thermal head to perform printing on the thermosensitive tape by a thermal method, while drawing out the thermosensitive tape from the tape cartridge. That is, each heat generating element in the thermal head is selective driven to generate heat so as to cause the thermosensitive layer of the thermosensitive tape to develop a color, thus printing dot pattern data.

SUMMARY

However, with the traditional tape cartridge using the thermosensitive tape, the color that can be printed is limited the single color developed in the thermosensitive layer and therefore only single-color printing can be performed. That is, there is the problem that printing using a plurality of colors, for example, multi-color printing cannot be performed.

The objective of the invention is to provide a print medium, a print medium unit and a printing device which enable multi-color printing using a thermal print head.

A print medium according to the invention includes: a base member; a first thermosensitive color developing material layer formed of a first thermosensitive color developing material; and a second thermosensitive color developing material layer formed of a second thermosensitive color developing material having a different reaction temperature from a reaction temperature of the first thermosensitive color developing material.

According to this configuration, the first thermosensitive color developing material layer, and the second thermosensitive color developing material layer in which the developed color becomes transparent (decolorized) at a predetermined reaction temperature are provided. Since the color developing temperature of the first thermosensitive color developing material layer and the decolorizing temperature that is the reaction temperature of the second thermosensitive color developing material layer are different from each other, by adjusting the heating temperature of the thermal print head, the first thermosensitive color developing material layer can be made to develop the color while the second thermosensitive color developing material layer can be made to develop the transparent color (decolorize). Thus, printing in the color developed in the first thermosensitive color developing material layer can be performed. Also, by selectively causing the second thermosensitive color developing material layer to develop the transparent color (decolorize) without causing the first thermosensitive color developing material layer to develop the color, printing in the color (original color) of the second thermosensitive color developing material layer can be performed. Therefore, by causing the color developed in the first thermosensitive color developing material layer and the color of the second thermosensitive color developing material layer to be different from each other, printing in these two colors can be performed. Thus, printing using two colors can be performed by the thermal print head. The "second thermosensitive color developing material" is a so-called thermosensitive decolorizing ink composition.

A print medium unit according to the invention includes: the above print medium; and an ink ribbon for thermally transferring an ink to the print medium. The ink ribbon has a reaction temperature that is different from the reaction temperature of the first thermosensitive color developing material and different from the reaction temperature of the second thermosensitive color developing material.

In this case, it is preferable that the reaction temperature of the ink ribbon is higher than the reaction temperature of the first thermosensitive color developing material and the reaction temperature of the second thermosensitive color developing material and that the reaction temperature of the second thermosensitive color developing material is lower than the reaction temperature of the first thermosensitive color developing material.

According to these configurations, the ink ribbon is further provided and the reaction temperature (transfer temperature) at which the ink ribbon transferred is different from the reaction temperature of the first thermosensitive color developing material layer and the reaction temperature (decolorizing temperature) of the second thermosensitive color developing material layer. Therefore, by adjusting the heating temperature of the thermal print head, printing in the color of the ink ribbon can be performed in addition to the two-color printing. Thus, by causing the color developed in the first thermosensitive color developing material layer, the color of the second thermosensitive color developing material layer and the color of the ink ribbon to be different from each other, printing in the three colors can be performed. In this way, printing using three colors can be performed by the thermal print head.

Another print medium unit according to the invention includes: a print medium having a base member and a first thermosensitive color developing material layer formed of a first thermosensitive color developing material; and an ink ribbon for thermally transferring an ink to the print medium. The ink ribbon has a different reaction temperature from a reaction temperature of the first thermosensitive color developing material layer.

According to this configuration, since the print medium having the first thermosensitive color developing material layer and the ink ribbon are provided and the reaction temperatures of these are different, by adjusting the heating temperature of the thermal print head, the first thermosensitive color developing material layer can be made to develop the color without thermally transferring the ink of the ink ribbon, and printing in the color developed in the first thermosensitive color developing material layer can be performed. Also, by heating the ink of the ink ribbon to the reaction temperature and thus thermally transferring the ink without causing the first thermosensitive color developing material layer to develop the color, printing in the color of the ink ribbon can be performed. Therefore, by causing the color developed in the first thermosensitive color developing material layer and the color of the ink ribbon to be different from each other, printing in these two colors can be performed. Thus, printing using two colors can be performed by the thermal print head.

Another print medium unit according to the invention includes: a print medium having a base member and a second thermosensitive color developing material layer formed of a second thermosensitive color developing material; and an ink ribbon for thermally transferring an ink to the print medium. The ink ribbon has a different reaction temperature from a reaction temperature of the second thermosensitive color developing material layer.

According to this configuration, since the print medium having the second thermosensitive color developing material layer and the ink ribbon are provided and the reaction temperatures of these are different. By adjusting the heating temperature of the thermal print head, the second thermosensitive color developing material layer can be selectively made to develop the transparent color without thermally transferring the ink of the ink ribbon, and thus printing in the color (original color) of the second thermosensitive color developing material layer can be performed. Also, by heating the ink of the ink ribbon to the reaction temperature and thus thermally transferring the ink while causing the second thermosensitive color developing material layer to develop the transparent color, printing in the color of the ink ribbon can be performed. Therefore, by causing the color developed in the second thermosensitive color developing material layer and the color of the ink ribbon to be different from each other, printing in these two colors can be performed. Thus, printing using two colors can be performed by the thermal print head.

A printing device according to the invention includes: the above print medium unit; a setting section where the print medium unit is set; and a printing unit which performs print processing on the print medium of the print medium unit thus set, by a thermal print head.

According to this configuration, by providing the print medium unit capable of printing using two colors, a printed material on which two-color printing is performed can be prepared.

DESCRIPTION OF EXEMPLARY EMBODIMENTS

Hereinafter, a print medium, a print medium unit and a printing device according to an embodiment of the invention will be described, referring to the accompanying drawings. In this embodiment, a tape cartridge to which the print medium unit of the invention is applied, and a tape printing device (printing device) using this tape cartridge are described as an example. This tape printing device is configured to print on a print tape as a processing target while feeding the print tape, and subsequently cut the printed part of the print tape so as to prepare a label. Particularly, this tape printing device has a configuration capable of performing multi-color printing with a thermal print head by using a special print tape and tape cartridge.

Figure 1:
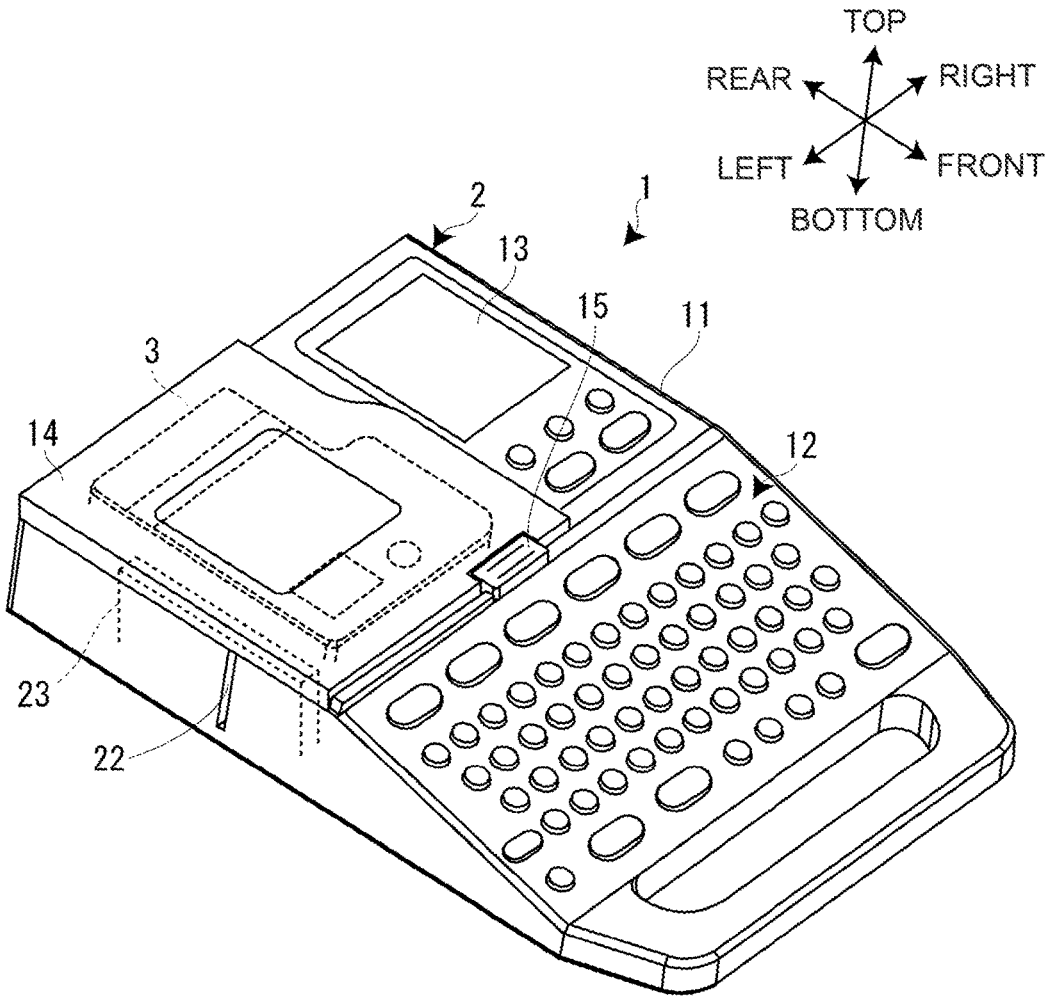
FIG. 1 is a perspective view showing a tape printing device according to an embodiment of the invention.
Figure 2:
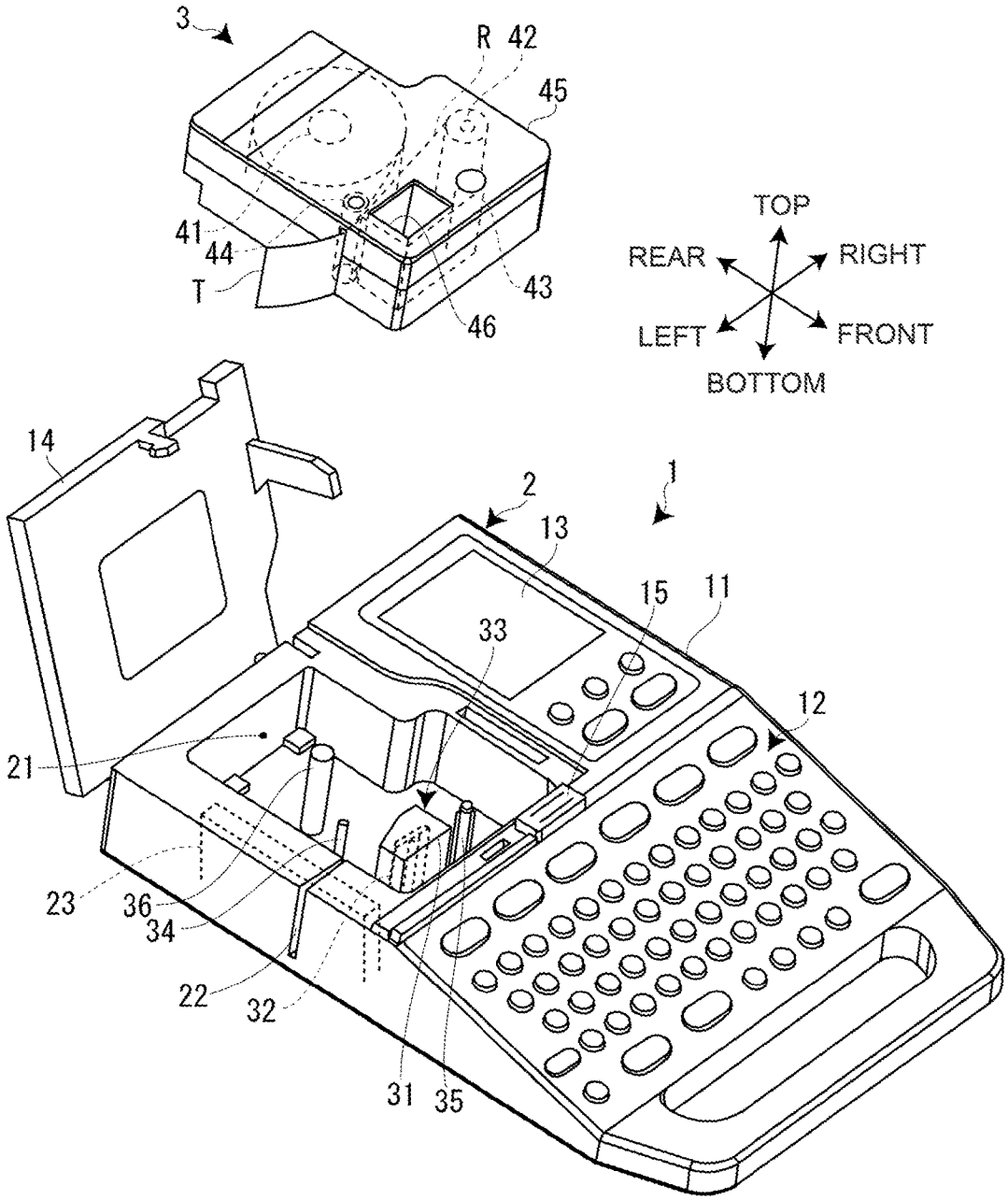
FIG. 2 is a perspective view showing the tape printing device in the state where a tape cartridge is removed.

As shown in FIG. 1 and FIG. 2, a tape printing device 1 has a device main body 2 which performs print processing on a print tape (print medium) T. In the tape printing device 1, a tape cartridge 3 accommodating the print tape T and an ink ribbon R is removably installed in the device main body 2. FIG. 1 shows the tape printing device 1 in the state where the tape cartridge 3 is installed. Meanwhile, FIG. 2 shows the tape printing device 1 in the state where the tape cartridge 3 is removed. Also, in the description below, the top and bottom, left and right, and front and rear sides of the tape printing device 1 are prescribed by arrows shown in each illustration.

The device main body 2 has an outer shell formed by a device case 11. On the top surface of the front half part of the device case 11, a keyboard 12 having various keys is arranged. Also, on the top right surface of the rear half part of the device case 11, a rectangular display 13 which displays an input result or the like from the keyboard 12 is arranged. Moreover, on the top left surface of the rear half part of the device case 11, an open/close cover 14 is broadly provided and a cover open button 15 which opens the open/close cover 14 is provided to the front side of the open/close cover 14.

Inside the open/close cover 14, a cartridge installation section (setting section) 21 for installing (setting) the tape cartridge 3 is formed as a recess. The tape cartridge 3 is removably installed in the cartridge installation section 21 in the state where the open/close cover 14 is opened.

In the left lateral part of the device case 11, a tape discharge port 22 connecting the cartridge installation section 21 to the outside is formed. A tape cutter 23 for cutting the print tape T is present in this tape discharge port 22.

Meanwhile, in the cartridge installation section 21, head unit 33 having a built-in thermal print head 32 in a head cover 31, a platen drive shaft 34 facing the thermal print head 32, a take-up drive shaft 35 for taking up the ink ribbon R, described later, and a positioning protrusion 36 for a tape reel 41, described later, are arranged.

The thermal print head 32 has a plurality of heat generating elements 32*a* (see FIGS. 5A-5E) arrayed in a line in a top-bottom direction and the plurality of heat generating elements 32*a* forms a line head. Also, each heat generating element 32*a* can heat a heating area corresponding to one pixel each and can individually adjust the heating temperature. As described in detail later, this embodiment has a configuration in which heat-driving is carried out selectively between no heating and heating at three stages of heating temperatures, by adjusting the heating temperature.

Also, under the cartridge installation section 21, a tape feed motor 81 (see FIG. 4) which rotates the platen drive shaft 34 and the take-up drive shaft 35 as a tape feed mechanism is provided inside. Moreover, inside the device case 11, a circuit board forming a control unit 83 (see FIG. 4) which controls the tape feed motor 81 and the like is installed.

In the tape cartridge 3, the tape reel 41 with the print tape T wound thereon, a ribbon reel 42 with the ink ribbon R wound thereon, and a ribbon take-up reel 43 which takes up the ink ribbon R are provided. Also, in the tape cartridge 3, a platen roller 44 facing the thermal print head 32, a cartridge case 45 accommodating these parts, and a head opening 46 which is formed penetrating the cartridge case 45 and in which the head unit 33 is inserted, are provided. In this way, in the tape cartridge 3, the print tape T in the state of being wound on the tape reel 41 is accommodated in the way that enables reeling off, and the ink ribbon R for thermally transferring the ink to the print tape T is accommodated. Details of the print tape T and the ink ribbon R will be described later.

When the tape cartridge 3 is installed in the cartridge installation section 21, the head cover 31 is inserted into head opening 46, the positioning protrusion 36 is inserted into the center hole of the tape reel 41, the platen drive shaft 34 is inserted into the center hole of the platen roller 44, and the take-up drive shaft 35 is inserted into the center hole of the ribbon take-up reel 43. Then, by the rotational driving of the platen drive shaft 34 and the take-up drive shaft 35, the print tape T is reeled off from the tape reel 41 and the ink ribbon R is reeled off from the ribbon reel 42. Then, the print tape T and the ink ribbon R thus reeled off are superimposed at the position of the head opening 46 and travel in parallel, and subsequently the print tape T is sent out of the cartridge case 45 and the ink ribbon R is taken up by the ribbon take-up reel 43. Also, in the section where the print tape T and the ink ribbon R travel in parallel, the platen roller 44 and the thermal print head 32 are present in the way of sandwiching these tape and ribbon, thus performing so-called print feed. That is, as the platen roller 44 rotates to feed the print tape T and the ink ribbon R and the thermal print head 32 is driven synchronously with this feed operation, print processing is performed on the print tape T.

Figure 3A:
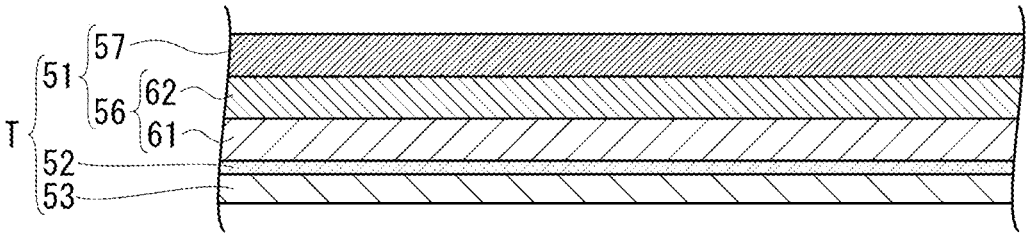
FIG. 3A and FIG. 3B are cross-sectional views showing a print tape and an ink ribbon.

Here, the print tape T and the ink ribbon R accommodated in the tape cartridge 3 will be described, referring to FIGS. 3A and 3B. As shown in FIG. 3A, the print tape T is formed by stacking a recording tape 51 to have a print image formed on the surface thereof and a release paper 53 attached to the back side of the recording tape 51 via an adhesive layer 52. That is, the print tape T has the configuration of an adhesive tape with the release paper 53.

The recording tape 51 is formed by stacking a thermosensitive tape 56 and a thermosensitive decolorizing material layer 57 as a second thermosensitive color developing layer formed by applying a thermosensitive decolorizing material as a second thermosensitive color developing material on the thermosensitive tape 56. The thermosensitive tape 56 is formed by stacking a base member 61 and a thermosensitive color developing material layer 62 as a first thermosensitive color developing material formed by applying a thermosensitive color developing material as a first thermosensitive color developing material on the base member 61. As a result, the recording tape 51 has a configuration in which the thermosensitive color developing material layer 62 and the thermosensitive decolorizing material layer 57 are stacked in order on the base member 61. In this embodiment, as the base member 61, a base member whose natural color (original color) is white is used.

The thermosensitive color developing material layer 62 is formed by applying the thermosensitive color developing material on the base member 61, as described above. In this embodiment, the thermosensitive color developing material is applied on the entire surface of the base member 61 to form the thermosensitive color developing material layer 62. This thermosensitive color developing material is a thermosensitive color developing composition containing a leuco pigment and a color developer and has a color developing temperature (color developing temperature characteristic) as a predetermined reaction temperature. That is, this thermosensitive color developing material is configured to be transparent when in a normal state (unheated state) and to develop a color and maintain the color developing state when heated to the predetermined color developing temperature or above. Also, as this thermosensitive color developing material, a material whose developed color is different from the natural color of the base member 61 is used. In this embodiment, as the thermosensitive color developing material, a material whose color developing temperature is 80° C. and which develops the color of black is used. The color developing temperature may be within the range (temperature zone) of 75° C. or above, and below 85° C.

The thermosensitive decolorizing material layer 57 is formed by applying the thermosensitive decolorizing material on the thermosensitive tape 56, as described above. In this embodiment, the thermosensitive decolorizing material is applied on the entire surface of the thermosensitive color developing material layer 62 to form the thermosensitive decolorizing material layer 57. This thermosensitive decolorizing material is a thermosensitive decolorizing ink composition (so-called reversible thermal discoloration composition ink) and has a predetermined decolorizing temperature (decolorizing temperature characteristic). That is, this thermosensitive decolorizing material is configured to be in color-developed state when in a normal state (unheated state) and to decolorize (become transparent) and maintain the decolorized state when heated to the decolorizing temperature as the predetermined reaction temperature or above. In other words, the thermosensitive decolorizing material develops the transparent color when the predetermined decolorizing temperature (reaction temperature) is applied. Also, as this thermosensitive decolorizing material, a material whose decolorizing temperature is lower than the color developing temperature of the thermosensitive color developing material is used. Moreover, as this thermosensitive decolorizing material, a material whose color (original color before decolorization) is different from the natural color of the base member 61 and the color developed by the thermosensitive color developing material is used. In this embodiment, as the thermosensitive decolorizing material, a material whose decolorizing temperature is 60° C. and whose color is red is used. The decolorizing temperature may be within the range (temperature zone) of 55° C. or above, and below 65° C.

Figure 3B:
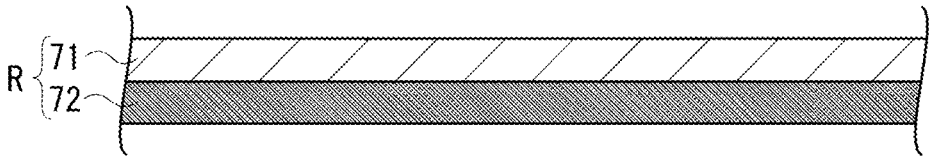

As shown in FIG. 3B, the ink ribbon R is formed by stacking a base 71 made up of a PET film or the like, and an ink layer 72 formed by applying a transfer ink on the base 71. As the transfer ink, an ink whose reaction temperature (transfer temperature (dissolution temperature or the like) (transfer temperature characteristic)) is higher than the color developing temperature of the thermosensitive color developing material and the decolorizing temperature of the thermosensitive decolorizing material is used. Also, as the transfer ink, an ink whose color is different from the natural color of the base member 61, the color developed by the thermosensitive color developing material and the color of the thermosensitive decolorizing material is used. In this embodiment, as the ink ribbon R, an ink whose transfer temperature is 100° C. and whose color is blue is used. This transfer temperature may be within the range (temperature zone) of 95° C. and above, and below 105° C.

Figure 4:
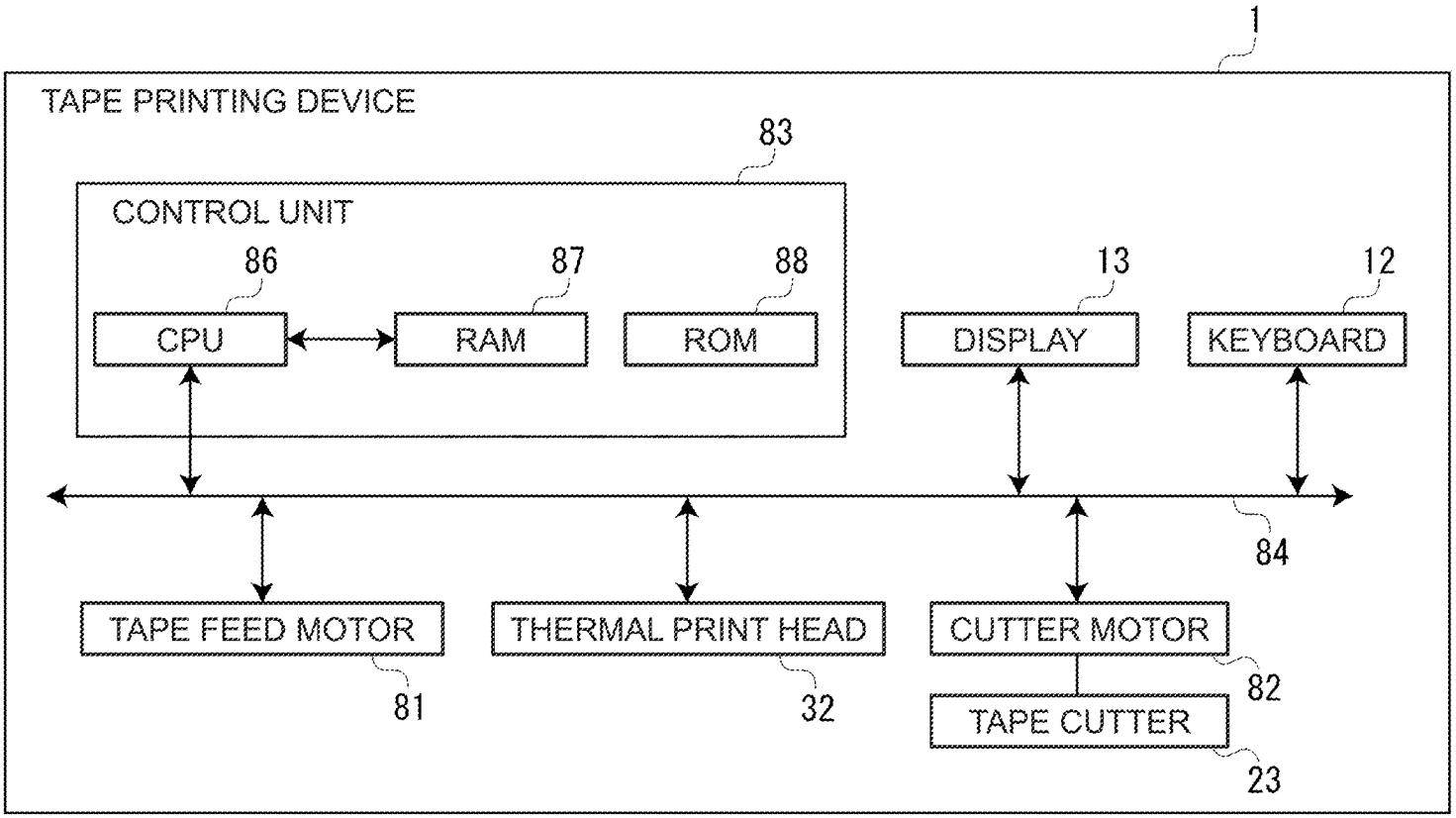
FIG. 4 is a control block diagram showing the control configuration of the tape printing device.

Next, the control configuration of the tape printing device 1 will be described, referring to FIG. 4. The tape printing device 1 includes the keyboard 12, the display 13, the thermal print head 32, the tape feed motor 81, a cutter motor 82 which drives the tape cutter 23, and the control unit 83 which controls these units. These components are connected via a bus 84.

The control unit 83 has a CPU 86 (central processing unit), a RAM 87 (random access memory), and a ROM 88 (read only memory). The CPU 86 performs various kinds of arithmetic processing. The RAM 87 is used as a work area when the CPU 86 performs various kinds of arithmetic processing. The ROM 88 stores a control program and control data used for the CPU 86 to perform arithmetic processing.

The keyboard 12 functions as an input unit for the user to input print information such as characters to be printed, and as an editing unit for the user to edit inputted print information. Also, the display 13 functions as a display unit to display results of input, results of editing, and print layouts.

The thermal print head 32 and the tape feed motor 81 function as a printing unit which performs printing on the print tape T while feeding the print tape T. Also, the cutter motor 82 is connected to the tape cutter 23 and functions as a cutting unit.

In the label preparation operation by the tape printing device 1, the control unit 83 prepares print data on the basis of print information inputted and edited via the keyboard 12, controls the printing unit (thermal print head 32 and tape feed motor 81) on the basis of the print data, and performs print processing on the print tape T. Then, the control unit 83 controls the cutter motor 82 to cut the printed part of the print tape T, thus preparing a label.

Here, details of the print processing will be described. In this tape printing device 1, in the where the print tape T and the ink ribbon R is tightly pressed by the thermal print head 32 and the platen roller 44, the platen roller 44 is rotated to feed the print tape T and the ink ribbon R, and at the same time, each heat generating element 32*a* of the thermal print head 32 is selectively drive-controlled, thus performing print processing. At this point, each heat generating element 32*a* of the thermal print head 32 is selectively drive-controlled among no heating, heating at a first heating temperature, heating at a second heating temperature, and heating at a third heating temperature by the control unit 83, as shown in FIGS. 5A-5E. The first heating temperature is a temperature below the transfer temperature of the ink ribbon R and below the color developing temperature of the thermosensitive color developing material, and also equal to or above the decolorizing temperature of the thermosensitive decolorizing material. The second heating temperature is a temperature below the transfer temperature of the ink ribbon R, and also equal to or above the color developing temperature of the thermosensitive color developing material and equal to or above the decolorizing temperature of the thermosensitive decolorizing material. The third heating temperature is a temperature equal to or above the transfer temperature of the ink ribbon R, equal to or above the color developing temperature of the thermosensitive color developing material, and equal to or above the decolorizing temperature of the thermosensitive decolorizing material. In this embodiment, the first heating temperature is 60° C., the second heating temperature is 80° C., and the third heating temperature is 100° C.

Figure 5A:
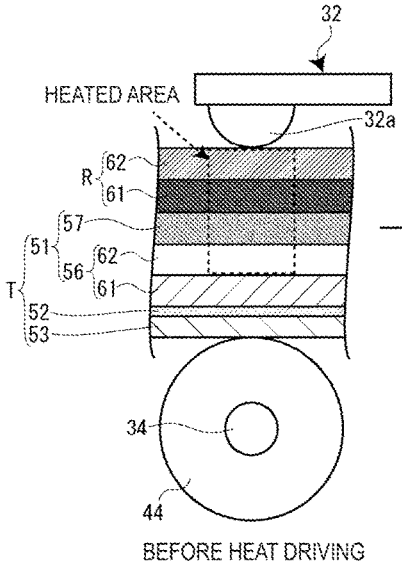
FIGS. 5A to 5E are explanatory views for explaining heat-driving control on heat generating elements in a thermal print head.
Figure 5B:
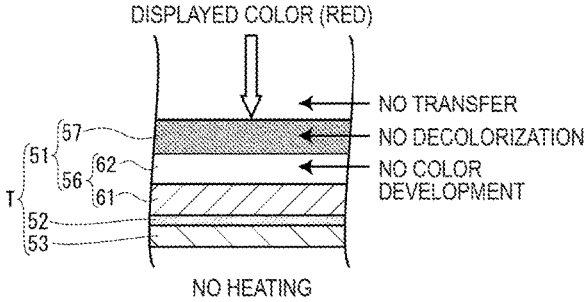
Figure 5C:
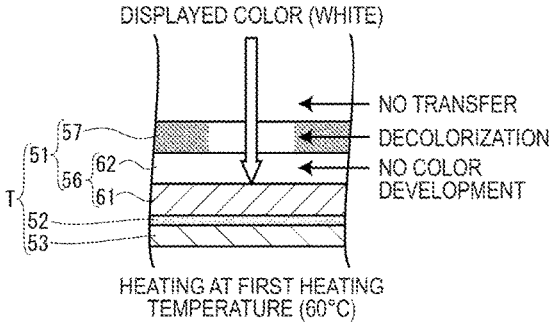
Figure 5D:
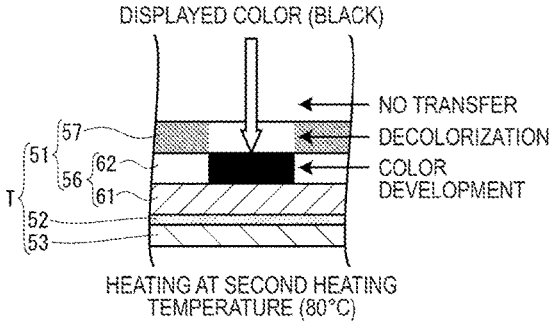

As shown in FIG. 5D, if no heating is carried out, the transfer ink of the ink ribbon R is not thermally transferred. Also, the thermosensitive color developing material of the thermosensitive color developing material layer 62 does not develop the color and the thermosensitive decolorizing material of the thermosensitive decolorizing material layer 57 does not decolorize. Consequently, the color (red) of the thermosensitive decolorizing material layer 57 is directly displayed as the color of one pixel.

Meanwhile, as shown in FIG. 5C, if heating is carried out at the first heating temperature (60° C.), the transfer ink of the ink ribbon R is not thermally transferred and the thermosensitive color developing material of the thermosensitive color developing material layer 62 does not develop the color. On the other hand, the thermosensitive decolorizing material of the thermosensitive decolorizing material layer 57 decolorizes. Consequently, the color (white) of the base member 61 is displayed as the color of one pixel.

Moreover, as shown in FIG. 5D, if heating is carried out at the second heating temperature (80° C.), the transfer ink of the ink ribbon R is not thermally transferred. On the other hand, the thermosensitive color developing material of the thermosensitive color developing material layer 62 develops the color and the thermosensitive decolorizing material of the thermosensitive decolorizing material layer 57 decolorizes. Consequently, the color (black) developed in the thermosensitive color developing material layer 62 is displayed as the color of one pixel.

Figure 5E:
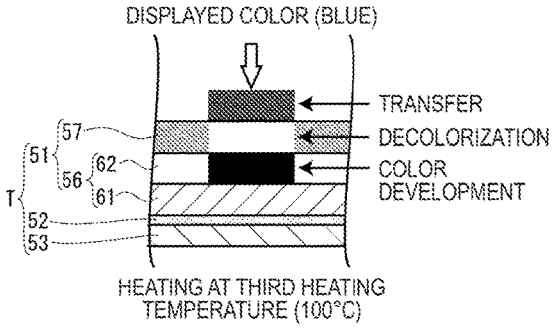

Also, as shown in FIG. 5E, if heating is carried out at the third heating temperature (100° C.), the transfer ink of the ink ribbon R is thermally transferred. Also, the thermosensitive color developing material of the thermosensitive color developing material layer 62 develops the color and the thermosensitive decolorizing material of the thermosensitive decolorizing material layer 57 decolorizes. Consequently, the color (blue) of the ink ribbon R is displayed as the color of one pixel.

Figure 6:
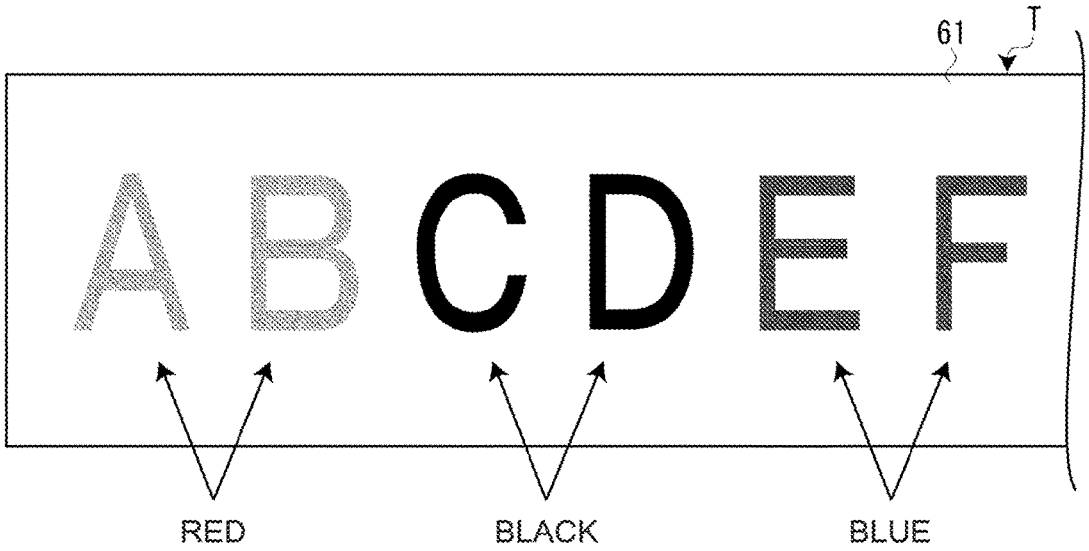
FIG. 6 is a view showing an example of printing by the tape printing device.

As described above, each heat generating element 32*a* of the thermal print head 32 is selectively drive-controlled among no heating, heating at the first heating temperature, heating at the second heating temperature, and heating at the third heating temperature, so as to control the color displayed by each pixel. This is carried out on all the pixels, thus performing printing in three colors (red, black, blue) on the base member 61 (white), as shown in FIG. 6. That is, three-color printing is performed.

According to the configuration as described above, since the print tape T (recording tape 51) having the thermosensitive color developing material layer 62 and the thermosensitive decolorizing material layer 57 is used and the color developing temperature and the decolorizing temperature of these are different, printing by a thermal method on the thermosensitive color developing material layer 62 and printing by a thermal method on the thermosensitive decolorizing material layer 57 can be performed together by the thermal print head 32. Thus, printing can be performed using the two colors of the color developed in the thermosensitive color developing material layer 62 and the color (original color) of the thermosensitive decolorizing material layer 57, and two-color printing can be performed by the thermal print head 32.

Also, since the tape cartridge 3 has the ink ribbon R in addition to the print tape T and the transfer temperature of the ink ribbon R is different from the color developing temperature of the thermosensitive color developing material layer 62 and the decolorizing temperature of the thermosensitive decolorizing material layer 57, the printing by the thermal method on the thermosensitive color developing material layer 62 and the thermosensitive decolorizing material layer 57, and printing by a thermal transfer method with the ink ribbon R can be performed together. Thus, printing can be performed using the three colors of the color developed in the thermosensitive color developing material layer 62, the color of the thermosensitive decolorizing material layer 57, and the color of the ink ribbon R, and three-color printing can be performed by the thermal print head 32. Also, if the color of the base member 61 is counted as one color, it can be said that four-color printing can be performed.

In the embodiment, it is assumed that the natural color of the base member 61 is white, that the color developed in the thermosensitive color developing material layer 62 is black, that the color of the thermosensitive decolorizing material layer 57 is red, and that the color of the ink ribbon R is blue. However, these colors are not limited to this example. For example, a configuration in which the three colors other than white are process colors such as RGB (red, green, blue) or CMY (cyan, magenta, yellow) may be employed. Also, for example, a configuration in which the color of the thermosensitive decolorizing material layer 57 is white, thus causing the color of the print tape T before print processing to be white, may be employed. Moreover, by causing a part or of the color developed in the thermosensitive color developing material layer 62, the color of the thermosensitive decolorizing material layer 57, and the color of the ink ribbon R to be a transparent color, it is possible to enable mixture of the respective colors.

Also, the relation (high and low) among the color developing temperature of the thermosensitive color developing material, the decolorizing temperature of the thermosensitive decolorizing material and the transfer temperature of the ink ribbon R is not limited to the example described in the embodiment, either. For example, as the thermosensitive decolorizing material, a material whose decolorizing temperature is higher than the color developing temperature of the thermosensitive color developing material may be used.

Moreover, each of the color developing temperature, the decolorizing temperature and the transfer temperature may be a temperature zone (temperature range). In such a case, a configuration in which the respective temperature zones do not overlap each other is employed.

While the configuration in which the thermosensitive color developing material is applied on the entire surface of the base member 61 is used in the embodiment, a configuration in which the thermosensitive color developing material is applied only in a print area on the surface of the base member 61 may be employed.

Also, while the configuration in which the thermosensitive decolorizing material is applied on the entire surface of the thermosensitive tape 56 is used in the embodiment, a configuration in which the thermosensitive decolorizing material is applied only in a print area on the surface of the thermosensitive tape 56 may be employed.

Moreover, while the thermosensitive tape 56 coated with the thermosensitive decolorizing material in advance is used in the embodiment, a configuration in which a coating mechanism for applying the thermosensitive decolorizing material is installed in the tape printing device 1 and in which the thermosensitive decolorizing material is applied on the thermosensitive tape 56 on the tape printing device 1 may be employed.

Furthermore, while the configuration in which the thermosensitive color developing material layer 62 is formed on the base member 61 with the thermosensitive decolorizing material layer 57 formed on the thermosensitive color developing material layer 62 is used in the embodiment, a configuration in which the thermosensitive decolorizing material layer 57 is formed on the base member 61 with the thermosensitive color developing material layer 62 formed on the thermosensitive decolorizing material layer 57 may be employed.

Figure 7A:
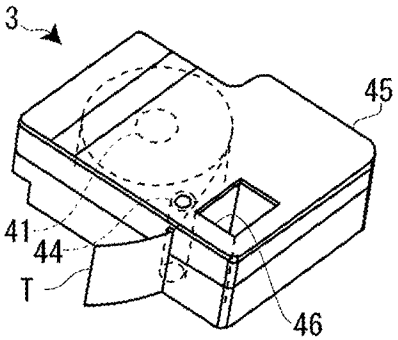
FIGS. 7A to 7F are views showing a modification of the tape cartridge.
Figure 7B:
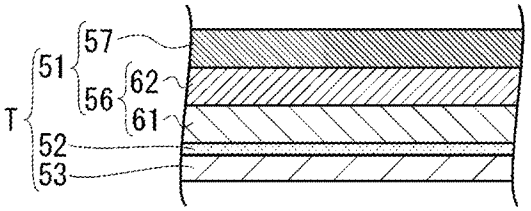
Figure 7C:
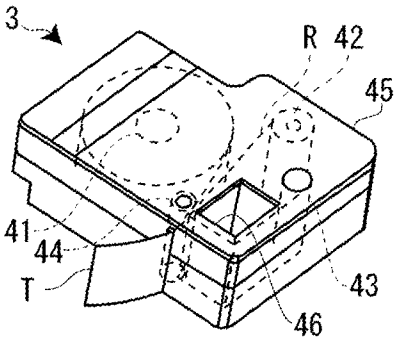
Figure 7D:
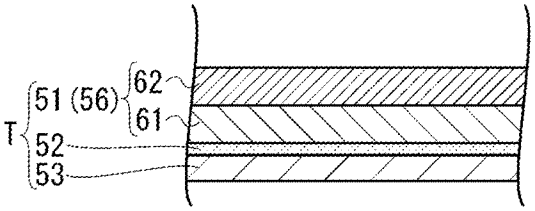
Figure 7E:
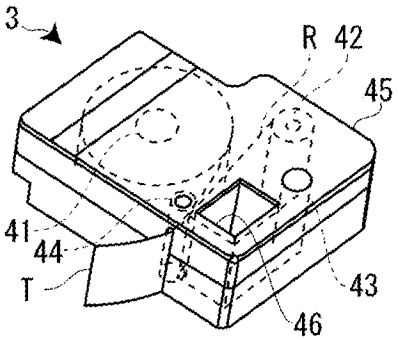
Figure 7F:
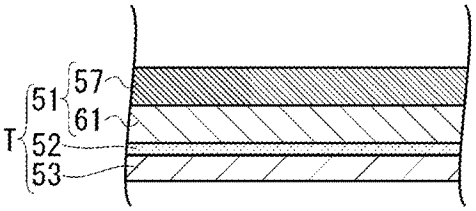

Also, while the configuration in which all of the thermosensitive color developing material layer 62, the thermosensitive decolorizing material layer 57 and the ink ribbon R are provided to perform three-color printing is used in the embodiment, a configuration in which two of these are provided to perform two-color printing may be employed. That is, as shown in FIGS. 7A and 7B, a configuration having the tape cartridge 3 in which the print tape T is provided as it is but the ink ribbon R is omitted so as to realize two-color printing with the thermosensitive color developing material layer 62 and the thermosensitive decolorizing material layer 57 may be employed (first modification). Also, as shown in FIGS. 7C and 7D, a configuration having the tape cartridge 3 in which the ink ribbon R is provided as it is but the thermosensitive decolorizing material layer 57 of the print tape T is omitted so as to realize two-color printing with the ink ribbon R and the thermosensitive color developing material layer 62 may be employed (second modification). Moreover, as shown in FIGS. 7E and 7F, a configuration having the tape cartridge 3 in which the ink ribbon R is provided as it is but the thermosensitive color developing material layer 62 of the print tape T is omitted so as to realize two-color printing with the ink ribbon R and the thermosensitive decolorizing material layer 57 may be employed. Particularly in the configuration in which the thermosensitive color developing material layer 62 is omitted (third modification), since the decolorizing temperature of the thermosensitive decolorizing material can be made relatively low, the difference between the decolorizing temperature of the thermosensitive deodorizing material and the transfer temperature of the ink ribbon R can be made as large as possible. Therefore, in two-color printing, the heat-driving control of the thermal print head 32 (heat generating elements 32*a*) can be easily performed.

In the embodiment, the invention is applied to the tape cartridge 3 having the print tape T and the print tape T. However, the invention is not limited to this as long as the invention is applied to a print medium and a print medium unit having the print medium. For example, the invention may be applied to a receipt sheet (receipt roll) and a receipt sheet unit having the receipt sheet. The invention may also be applied to print paper (so-called copy paper or printer paper) and a print paper unit having the print paper. Of course, the invention may also be applied to a paper roll or may be applied to flat paper.

Also, while the invention is applied to the tape printing device 1 using the print tape T in the embodiment, the invention is not limited to this as long as the invention is applied to a printing device. For example, the invention may be applied to a receipt printing device using a receipt sheet. The invention may also be applied to a printing device using the above print paper.

The invention claimed is:

1. A print medium comprising:

a base member;

a first thermosensitive color developing material layer formed of a first thermosensitive color developing material; and a second thermosensitive color developing material layer formed of a second thermosensitive color developing material having a different reaction temperature from a reaction temperature of the first thermosensitive color developing material, wherein the first thermosensitive color developing material layer and the second thermosensitive color developing material layer are each configured to develop a color in response to application of heat.

2. A print medium unit comprising:

the print medium according to claim 1; and an ink ribbon for thermally transferring an ink to the print medium;

wherein the ink ribbon has a reaction temperature that is different from the reaction temperature of the first thermosensitive color developing material and different from a color developing temperature of the second thermosensitive color developing material.

3. The print medium unit according to claim 2, wherein the reaction temperature of the ink ribbon is higher than the reaction temperature of the first thermosensitive color developing material and the reaction temperature of the second thermosensitive color developing material, and the reaction temperature of the second thermosensitive color developing material is lower than the reaction temperature of the first thermosensitive color developing material.

4. A printing device comprising:

the print medium unit according to claim 2;

a setting section where the print medium unit is set; and a printing unit which performs print processing on the print medium of the print medium unit thus set, by a thermal print head.

5. A print medium unit comprising:

a print medium having a base member, a first thermosensitive color developing material layer formed of a first thermosensitive color developing material, and a second thermosensitive color developing material layer formed of a second thermosensitive color developing material; and an ink ribbon for thermally transferring an ink to the print medium;

wherein the ink ribbon has a different reaction temperature from at least one of a reaction temperature of the first thermosensitive color developing material layer and a reaction temperature of the second thermosensitive color developing material layer.

6. The print medium unit of claim 5, wherein the second thermosensitive color developing material is configured to be in a color-developed state when in an unheated state, and to decolorize when heated to the reaction temperature of the second thermosensitive color developing material layer.

7. The print medium unit of claim 4, wherein the first thermosensitive color developing material is configured to be transparent when in an unheated state, and to develop a color when heated to the reaction temperature of the first thermosensitive color developing material layer.

* * * * *